US005527202A

United States Patent [19]

Morgan et al.

[11] Patent Number: 5,527,202

[45] Date of Patent: Jun. 18, 1996

[54] FRAME FOR BRASSIERE CUPS

[75] Inventors: Harvey S. Morgan, Woodmere; Joseph Horta, Yonkers, both of N.Y.

[73] Assignee: S & S Industries, Inc., New York, N.Y.

[21] Appl. No.: 402,738

[22] Filed: Mar. 13, 1995

Related U.S. Application Data

[63] Continuation of Ser. No. 189,940, Feb. 1, 1994, abandoned.

[51] Int. Cl.[6] ..... A41C 3/10; A41D 27/00

[52] U.S. Cl. ..... 450/48; 450/45; 450/41

[58] Field of Search ..... 2/73, 67; 450/41, 450/42, 43, 44, 45, 46, 47, 48, 49, 50, 51, 52, 53, 54, 79, 80

[56] References Cited

U.S. PATENT DOCUMENTS

| | | | |
|---|---|---|---|
| 1,837,958 | 12/1931 | Willmann | 450/46 |
| 2,622,244 | 12/1952 | Alberts | 450/49 |
| 2,705,800 | 4/1955 | Schwartz | 450/52 |
| 2,769,180 | 11/1956 | Tareau et al. | 450/45 |
| 3,033,205 | 5/1962 | Walters | 450/48 X |
| 3,599,643 | 8/1971 | Schwartz | 450/41 |

*Primary Examiner*—Jeanette E. Chapman
*Attorney, Agent, or Firm*—Abelman, Frayne & Schwab

[57] ABSTRACT

A frame for breast cups of a brassiere is formed in such a manner that it is relatively inflexible in the plane of the frame and relatively flexible in the direction of the thickness of the frame, the frame when viewed in edge view, being in the form of a dihedral, thus causing a bridge between the respective frames to move inwardly towards the sternum of the wearer of the brassiere on the application of a force acting to move free ends of the respective frames away from each other.

10 Claims, 2 Drawing Sheets

FRAME FOR BRASSIERE CUPS

This application is a continuation application under 37 C.F.R. 1.62 of prior application Ser. No. 08/189,940, filed on Feb. 1, 1994, now abandoned.

FIELD OF THE INVENTION

This invention relates to a frame for use in the construction of a brassiere garment, and which is employed as reinforcements for the lower periphery of breast cups of such garments.

BACKGROUND OF THE INVENTION

It has long been known to provide breast cups of brassieres with a reinforcing frame that extends peripherally of the lower edge of the breast cups, thus to provide stabilization for the garment when in use.

More commonly, dual such frames are provided one for each breast cup, the respective breast cups being interconnected with each other by a gusset panel, thus to provide for relative movement between the breast cups of a limited extent, thereby enhancing the comfort of the garment to the wearer thereof.

It is also known, for example, from Rowell U.S. Pat. No. 3,209,756 to form the respective frames from metal wire of rectangular cross section, which is so positioned that the width and major dimension of the metal wire is to extend substantially parallel to the wearer's skin, the wire being of substantially lesser thickness than is its width. To avoid cutting and abrasion of the pocket of the garment within which the wire is contained, it further is commonly known to encapsulate the wire in a flexible plastics material.

It also is known from Rowell U.S. Pat. No. 3,209,756 to form a double arcuate breast frame from wire of rectangular cross-section, subsequent to which the yoke formed at the interconnection of the respective breast frames is encased in a coating of plastics material, again, to alleviate abrasion and wear to the pocket of material within which the dual breast frame is confined within the garment.

According to Rowell's teachings, the double breast frame, when in an unstressed condition, extends in a single plane, the respective frames thus being coplanar.

Rowell teaches a wire of rectangular cross-section in which the proportioning of the width to thickness is approximately 2:1, such a wire being stiff and unyielding in all directions, including flexing of the wire in a direction transverse to the width thereof, thus providing a frame, especially in a double frame construction that is highly resistant to flexure and yielding, both in vertical directions and transverse directions relative to the wearer's torso.

In Rowell's double frame construction, any attempt to bow the double frame for it to conform to the wearer's body is encumbered with resistance to flexing of the frame, and also automatically will result in the bridge between the respective frames being moved laterally away from the wearer's sternum, thus presenting an unsightly appearance of gapping at the wearer's cleavage.

SUMMARY OF THE INVENTION

It is an object of this invention to overcome this disadvantage in the Rowell construction, and, to provide a double frame for a brassiere in which the interconnecting bridge between the respective frames, instead of moving away from the user's sternum will be caused to move more closely into engagement with the user's sternum, thus presenting a garment of enhanced appearance when worn by the user.

Additionally, it is an object of this invention to take advantage of the ease of handling of a one-piece double frame construction in the assembly of a brassiere garment, with the cost advantages attendant thereon.

According to the present invention, a one-piece double frame for a brassiere is formed from a single length of wire of rectangular cross-section, including the frames themselves and the interconnecting bridge.

As opposed to the teachings of the prior art, the wire employed in forming the one-piece double frame is formed of a thickness considerably less than that contemplated in the prior art, the thickness of the flat metal wire being in the range of 0.3 to 0.15 of the width of the metal wire, for example, if the metal wire has a width of 2 mm, then, the thickness of the metal wire is held to within the range of 0.5 mm and 0.15 mm.

The actual thickness of the flat metal wire will, to a large extent, depend on the stiffness of the metal wire and its resistance to bending in the plane lateral to the width of the metal wire, the essential consideration being that the one-piece double frame shall be readily flexible in the direction transverse to the composite frame, while, being of substantial rigidity in the plane of the width of the metal wire.

The one-piece double frame is pre-formed for free ends of the frame to extend in the planes of a dihedral on opposite sides of the bridge between the respective frames, thus, initially to conform substantially to the transverse contour of a wearer's torso.

Optionally, the respective frames, instead of lying entirely within the dihedral planes, can be appropriately curved, further to conform them to the transverse contour of the wearer's torso.

So forming the frame, relieves the frame from initial stresses as the garment is applied to the wearer's body, and, when conformed to the wearer's body, results in far less strain in the frame, and, in turn tends to eliminate zones of high pressure and stress on the user's torso, or, in the alternative, to gapping of the frame away from the user's torso.

Additionally, the free ends of the frame are formed such that, at their free ends, they extend at an angle towards one another.

This inward convergence of the free ends of the respective frames, in combination with the dihedral formation of the one-piece double frame produces the most beneficial effect of causing the bridge of the one-piece double frame to move towards instead of away from the wearer's sternum, thus minimizing gapping of the garment at the wearer's cleavage, and, in addition, providing better definition and shaping of the wearer's breasts.

The extent of movement towards the sternum of the bridge of the one-piece double frame will, of course, depend on numerous considerations, including the lateral give in the fabric of the breast cups, and the extent of tightening of the torso straps of the brassiere garment.

When properly sized to the intended wearer of the brassiere, and properly applied to the wearer's torso, the free ends of the respective frames will have been moved laterally away from one another, the forces produced in the one-piece double frame then acting to move the bridge of the one-piece double frame inwardly towards the user's sternum, while, at the same time, avoiding any localized zones of discomfort to the wearer, and in fact, enhancing the comfort of the garment to the wearer.

DESCRIPTION OF THE DRAWINGS

The invention will now be described with reference to the accompanying drawings, which are illustrative of a preferred embodiment of this invention, and, in which.

DESCRIPTION OF THE PREFERRED EMBODIMENT

In view of the difficulty of illustrating the frame of the present invention in three-dimensional form, and, difficulty in describing the relative movements of differing portions of the frame, resort is being taken to describing the frame and the relative movements of the frame when under stressing by reference to the X,Y and Z axes employed in defining directions in solid geometry.

Figure 1:
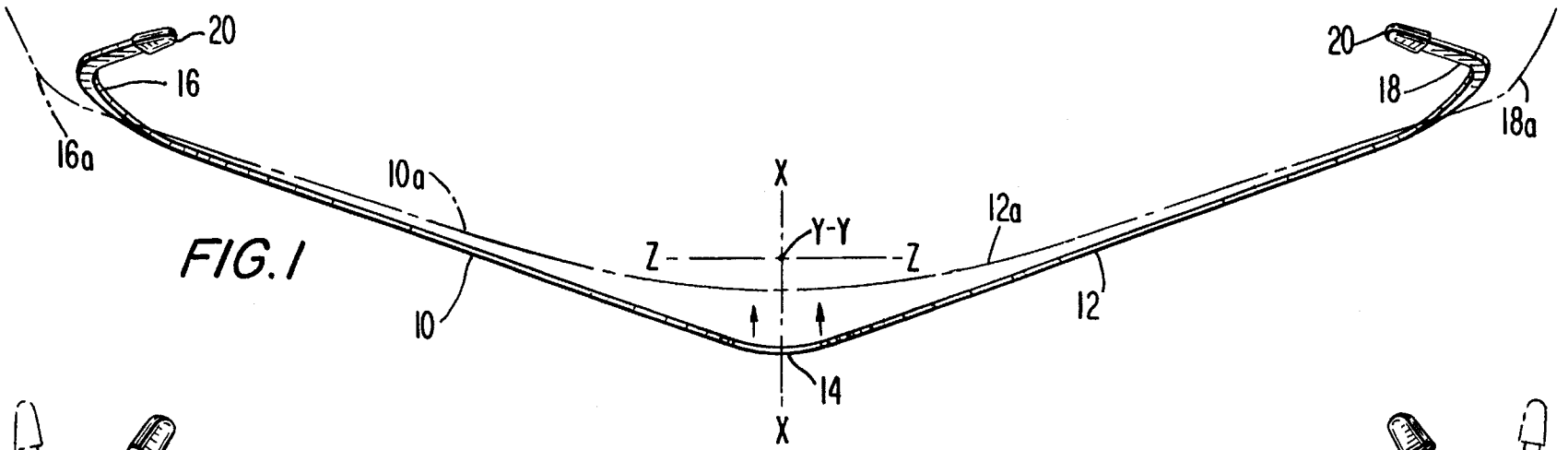
FIG. 1 is a front elevation of the one-piece double frame of the present invention.

Referring firstly to FIG. 1, it will be seen that the one-piece double frame of the present invention comprises two breast frames 10 and 12 that are interconnected by a bridge 14, the respective breast frames 10 and 12 having free ends 16 and 18, respectively.

Figure 2:
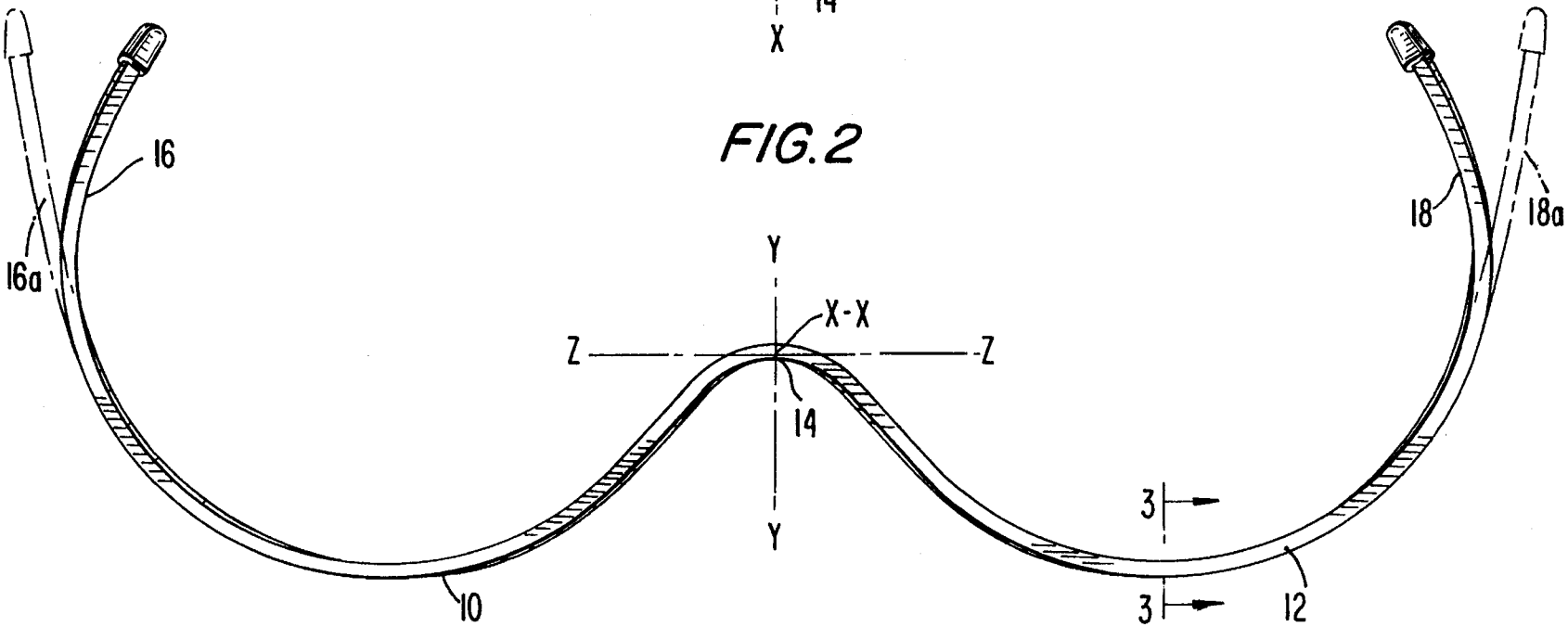
FIG. 2 is a plan-view of FIG. 1 illustrating the formation of the frame as a dihedral.

As opposed to being of planar form, i.e., one in which each of the breast frames 10 and 12, the bridge 14 and the free ends 16 and 18 lie in the Y-Z plane, the frame is preformed at the bridge 14 for the respective breast frames 10 and 12 to extend at angles to the Y-Z plane in the form of a dihedral, as is illustrated in FIG. 2.

The free ends 16 and 18 of the respective breast frames 10 and 12 continue in the same plane as the dihedral, but, additionally tow inwardly towards each other in the X-Z plane.

It is in this condition of the frame that the frame is sewn into the brassiere, the fabric employed in fabrication of the brassiere intentionally being provided with sufficient lateral stretch or movement to permit subsequent distortion of the one-piece double in the manner now described.

Referring now to FIG. 1, on tensioning of the torso straps of the garment [not shown] the free ends 16 and 18 of the respective frames 10 and 12 will be pulled laterally away from one another, such that they assume a position as indicated in chain dotted lines at 16*a* and 18*a*.

This outwards movement of the free ends 16 and 18, due to the dihedral formation of the frame, will cause the bridge 14 of the frame to move along the X-X axis, and, towards the sternum of the wearer, while at the same time, the ends 16 and 18 of the frame remain substantially in a plane parallel to the plane of the Y-Z plane, relative movement of the free ends 16 and 18 of the frames 10 and 12 being dominantly in the Y-Z plane.

Figure 3:
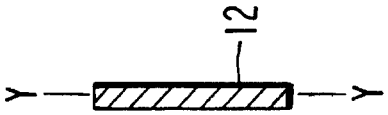
FIG. 3 is a cross-section representative of the cross-section of the frame taken on the line 3—3 of FIG. 1.

These relative movements between the respective portions of the one-piece double frame are permitted due to the thinness of the frame as related to the width thereof as illustrated in FIG. 3, which has a thickness which is in the range of 0.5 to 0.15 the width of the frame in the direction of the Y-Y axis. Considerable resistance to bending in the Y-Z plane is provided by the relatively large width of the frame in the Y-Z plane as compared to the thickness of the frame. This readily permits bending of the frame out of the Y-Z plane in the direction of the X-X axis, i.e., in the direction of the thickness of the frame.

This enables the frame to conform readily and with ease to the contour of the user's torso in the lateral direction, while providing adequate support for the user's breasts, with the added advantages that the bridge of the frame 14 is moved into proximity with the wearer's sternum. The free ends 16 and 18 of the frame can move freely in the direction of the X-X axis and into comfortable fitting relation with the lateral sides of the user's breasts adjacent the armpits of the wearer. At the same time maximum rigidity of the frame is retained in all directions extending perpendicular to the X-Z plane.

Thus, a frame is provided that readily can move into conformity with the contour of the wearer's torso, while at the same time, providing maximum resistance to sagging of the breast cups or movements in a vertical direction relative to the user's torso.

This provides the wearer with enhanced comfort while wearing the garment, and also, provides the user with freedom of movement of the wearer's body.

Figure 4:
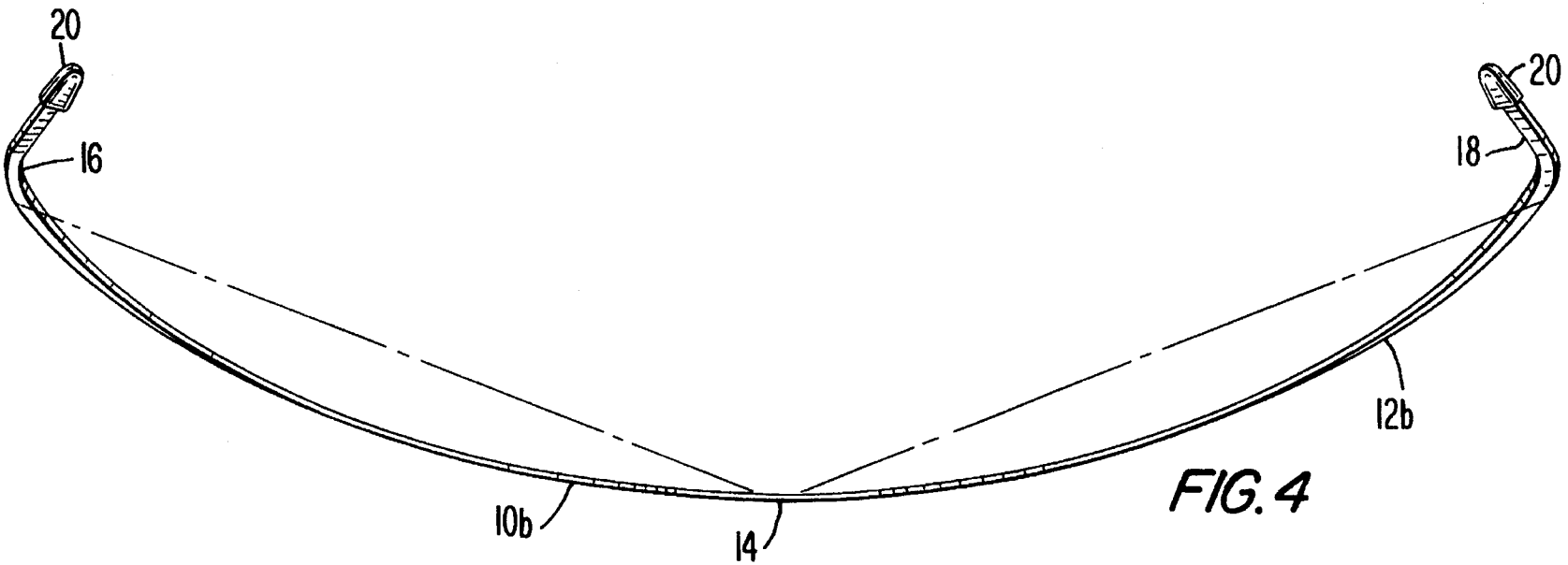
FIG. 4 is a plan view of the frame showing a modification thereof.

Optionally, and as illustrated in FIG. 4, the respective frames 10 and 12, instead of lying in the planes of the dihedral can be concavely bowed, as indicated at 10*b*, 12*b*, this providing initial conformity and further increasing final conformity with the wearer's torso.

A somewhat similar effect to that produced in the brassiere frame of the present invention can be illustrated by flexing of a thin steel ruler that has been arranged with its width in a vertical plane. While it is impossible to bend the steel ruler in the vertical plane, it can be flexed with comparative ease in directions lateral thereto, it being relatively easy to wrap the steel ruler about a curved or cylindrical surface, that surface approximating the lateral contour of the user's torso. As the steel rule is arranged with its width in a vertical plane, it is entirely resistant to bending in the vertical direction.

By use of the frame of the present invention, not only is a garment produced that is of enhanced comfort to the wearer, but also, a garment is provided that is of enhanced appearance at the point of display for sale, particularly in the event that the garment is displayed on a store mannequin.

As will be readily apparent, instead of being formed as a one-piece double frame, the frame can be formed from dual frames that have been rigidly interconnected at their adjacent ends, for example, by welding, soldering or brazing, or, their encapsulation within a rigid bridging member, for example, of a rigid plastics material, in order to provide a composite structure that functions in the same manner as the one-piece double frame described as the preferred embodiment of this invention.

Further, while the metal wire has been so far described as being a naked metal wire, clearly, and as is well known in the art, the metal wire can be encapsulated in a flexible plastics material in order to reduce abrasion and wearing of the fabric of the garment. Further, and for the same reasons, the free ends of the frames can be tipped, as indicated at 20, in any known manner according to the prior art.

Further, while the frame of the present invention has been described with reference to flat metal wire having a planar surfaces in the direction of its width, those surface can be concavely or convexly bowed, again as is known in the art, the major requirement being that as is illustrated in FIG. 3, the frame shall be of considerably greater width than its thickness, in order to enable ready flexure in directions parallel to the X-X axis, while providing maximum resistance to bending in directions perpendicular to the X-Z plane.

What is claimed is:

1. A frame for a brassiere of the type including dual frames for supporting respective breast cups of said brassiere, and a bridging member rigidly interconnecting the respective frames at adjacent ends of said respective frames, further including:

said respective frames each being formed of a strip material having a width "w" in excess of the thickness "t" thereof, whereby said frames are relatively inflexible in the direction of the width "w" of said material and are readily flexible in the direction of the thickness "t" of said material, the width of said strip material providing a frontal surface of said respective frame, and said frame when in an unstressed condition, and when viewed in the direction of the thickness of said strip material being in the form of a dihedral having its center located at said bridging member.

2. The frame of claim 1, in which the thickness of said strip material is in the range of 0.5 to 0.15 the width of said strip material.

3. The frame of claim 1, in which said strip material is a flat metal wire having a thickness in the range of 0.5 to 0.15 the width of said metal wire.

4. The frame of claim 1, in which said frame when viewed in plan view is in the form of a dihedral having its center at said bridging member, and, respective free ends of said respective frames converge inwardly towards each other in an unstressed condition of said frame, said respective free ends being capable of flexure in a direction away from each other in order to deform said frame in a resultant direction in which said bridging member is moved towards the plane of said free ends.

5. The frame of claim 4, in which said respective frames are concavely bowed relative to the associated plane of said dihedral.

6. The frame of claim 1, in which said strip material is one of high carbon and stainless steel flat metal wire having a thickness in the range 0.5 to 0.15 the width of said metal wire.

7. The frame of claim 3, in which said flat metal wire is encapsulated in resilient plastics material.

8. The frame of claim 1, in which said respective frames and said bridging member are formed integrally with one another.

9. The frame of claim 1, in which said respective frames are formed independently of one another, further including means rigidly interconnecting said respective frames at adjacent ends thereof.

10. The frame of claim 1, further including tips applied to free ends of said respective frames.

* * * * *